US006749240B1

(12) United States Patent
Burr et al.

(10) Patent No.: US 6,749,240 B1
(45) **Date of Patent: *Jun. 15, 2004**

(54) METHOD OF ADVERTISING AND DISTRIBUTING SALES INCENTIVES ON A USEFUL DEVICE

(75) Inventors: Brian M. Burr, Oceanside, CA (US); Carl Wesley Truly, Oceanside, CA (US); Martin R. Bozlee, Oceanside, CA (US)

(73) Assignee: Grabb-It Inc., Oceanside, CA (US)

( * ) Notice: Subject to any disclaimer, the term of this patent is extended or adjusted under 35 U.S.C. 154(b) by 110 days.

This patent is subject to a terminal disclaimer.

(21) Appl. No.: 10/017,220

(22) Filed: Dec. 14, 2001

Related U.S. Application Data

(60) Continuation-in-part of application No. 09/513,346, filed on Feb. 25, 2000, now abandoned, which is a continuation-in-part of application No. 29/117,834, filed on Jan. 31, 2000, now Pat. No. Des. 438,797, which is a division of application No. 29/103,360, filed on Apr. 13, 1999, now abandoned.

(51) Int. Cl.[7] ..... A45F 5/10; G09F 23/00

(52) U.S. Cl. ..... 294/171; 283/56

(58) Field of Search ..... 294/137, 170, 294/171; 705/14, 7, 10; 283/56; 206/831

(56) References Cited

U.S. PATENT DOCUMENTS

| | | | | |
|---|---|---|---|---|
| 1,691,467 A | | 11/1928 | Carver | 294/171 |
| 2,215,116 A | | 9/1940 | Crary | 294/171 |
| 2,274,605 A | | 2/1942 | Hoffmeister | D8/322 |
| 2,501,037 A | | 3/1950 | Fox | 294/158 |
| 2,796,210 A | | 6/1957 | Phillips | 294/159 |
| 3,220,634 A | * | 11/1965 | Rubinstein | 206/459.5 |
| 3,314,592 A | | 4/1967 | Streich | 206/831 |
| D227,660 S | | 7/1973 | Konno | 294/171 |
| 3,804,323 A | | 4/1974 | Bemel | 206/831 |
| D239,919 S | | 5/1976 | Wilson | D9/434 |
| 4,262,385 A | | 4/1981 | Norman | 16/114 |

(List continued on next page.)

FOREIGN PATENT DOCUMENTS

| | | | |
|---|---|---|---|
| AT | 196775 | 3/1958 | 294/171 |
| CA | 2051019 | 9/1991 | 294/171 |
| DE | 3528037 A | 2/1987 | B65D/33/06 |
| DE | 3918355 A | 12/1990 | 294/171 |
| EP | 0 085 524 A1 | 8/1983 | A45F/5/10 |
| EP | 85524 | 8/1993 | 294/171 |
| GB | 2147800 A | 5/1985 | 294/171 |
| GB | 2241432 A | 9/1991 | 294/171 |
| GB | 2246285 A | 1/1992 | 294/171 |
| GB | 2255497 A | 11/1992 | 294/137 |

OTHER PUBLICATIONS

Supermarket News article "Designer Sacks: a new Medium for the Message", dated Aug. 1, 1988.*
Advertising Age article "Grocery Bag Coupon Booklets Checking out additional Markets", dated Feb. 13, 1984.*

*Primary Examiner*—Dean J. Kramer
(74) *Attorney, Agent, or Firm*—Kilpatrick Stockton LLP

(57) ABSTRACT

A system and method for advertising and providing sales incentives to customers of stores. This method includes placing advertisements or sales incentives, which can include coupons or rebates, on a useful device such as a carrying strap containment device and receiving payment for doing so. The carrying strap containment devices are packaged and distributed to stores either directly or through a store's distribution system. Each store distributes the carrying strap containment devices to its customers by attaching the devices to the straps of shopping bags and giving the bags to the customers during the checkout process. The stores are paid for distributing the devices based on the number of devices distributed. The effectiveness of this system can be determined by comparing the number of devices distributed with the number of sales incentives redeemed.

31 Claims, 2 Drawing Sheets

U.S. PATENT DOCUMENTS

| | | | | | |
|---|---|---|---|---|---|
| 4,417,609 | A | | 11/1983 | Sherwood | 206/831 |
| 4,617,215 | A | | 10/1986 | Telesco | 283/56 |
| 4,796,940 | A | | 1/1989 | Rimland | 294/171 |
| 4,932,702 | A | | 1/1990 | Sweeny | 294/171 |
| 4,909,636 | A | * | 3/1990 | De Matteis et al. | 383/8 |
| D307,712 | S | | 5/1990 | Ralls et al. | D9/344 |
| 4,920,675 | A | | 5/1990 | Mashimo | 283/56 |
| 4,982,989 | A | | 1/1991 | Sweeny | 294/171 |
| 5,005,891 | A | | 4/1991 | Lunsford | 294/171 |
| D317,246 | S | | 6/1991 | Driscoll | D9/434 |
| 5,060,793 | A | * | 10/1991 | Hyun et al. | 206/232 |
| D325,156 | S | | 4/1992 | Sweeny | D9/434 |
| 5,257,845 | A | | 11/1993 | McConnell | 294/137 |
| 5,368,393 | A | | 11/1994 | Normann | 383/13 |
| 5,425,497 | A | | 6/1995 | Sorensen | 220/738 |
| D363,876 | S | | 11/1995 | Morissette | D3/328 |
| 5,487,582 | A | | 1/1996 | Bourgeois et al. | 294/171 |
| 5,599,052 | A | | 2/1997 | Van Davelaar | 294/170 |
| D380,382 | S | | 7/1997 | Rhone et al. | D9/434 |
| 5,658,029 | A | | 8/1997 | Franko | 294/171 |
| D395,602 | S | | 6/1998 | Sakko | D9/434 |
| 5,775,757 | A | | 7/1998 | Tipp | 294/171 |
| 5,803,522 | A | | 9/1998 | Lisbon | 294/171 |
| 5,865,494 | A | | 2/1999 | Tipp | 294/171 |
| 5,881,432 | A | | 3/1999 | Good | 16/114 |
| D408,259 | S | | 4/1999 | Hagen | D9/434 |
| 5,992,803 | A | | 11/1999 | LeRoux | 248/100 |
| 5,996,180 | A | | 12/1999 | Eisenzopf | 16/406 |
| 6,073,372 | A | * | 6/2000 | Davis | 40/124.16 |
| D438,797 | S | | 3/2001 | Bozlee | D9/434 |
| D442,085 | S | | 5/2001 | Bozlee | D9/434 |
| D451,389 | S | | 12/2001 | Bozlee | D9/434 |
| 6,354,645 | B2 | * | 3/2002 | Bozlee | 294/171 |
| 6,378,925 | B1 | * | 4/2002 | Greenlee | 294/171 |
| 6,568,599 | B2 | * | 5/2003 | Lahey et al. | 235/487 |

* cited by examiner

METHOD OF ADVERTISING AND DISTRIBUTING SALES INCENTIVES ON A USEFUL DEVICE

RELATED APPLICATIONS

This application is a continuation-in-part of co-pending nonprovisional patent application Ser. No. 09/513,346, filed on Feb. 25, 2000, entitled "Device and Method for Advertising and Carrying Bags with Handles," now abandoned, which is a continuation-in-part of Design patent application Ser. No. 29/117,834, now U.S. Pat. No. D438,797, filed Jan. 31, 2000 entitled "Handle," which is a divisional application of Design patent application Ser. No. 29/103,360 filed Apr. 13, 1999, entitled "Handle" (now abandoned). These applications are incorporated by reference herein.

FIELD OF THE INVENTION

This invention relates to promotional activities, advertising, and purchasing incentives, and more particularly to systems and methods for placing advertisements and coupons on useful structures for distribution to retail customers, including handles for plastic bags.

BACKGROUND OF THE INVENTION

For years, manufacturers, advertisers, and marketing consultants have invested countless hours in developing various methods for influencing the purchasing decisions made by retail customers. Each advertising initiative is focused on influencing customer decisions, either through apparent or subtle means. Advertisers have advertised products using direct mailings, newspapers, fliers, magazines, radio, television, and banners, just to name a few.

One obstacle to any advertising campaign is that advertising can be expensive. For instance, the gross cost of advertising via radio can be about $23 per thousand impressions, calculated using a combined metro and rural advertising rate. One impression is a single person looking at one advertisement one time. If the same person looks at the advertisement multiple times, for instance, once while driving to work and once while returning home from work, each time the person looks at the advertisement is an impression. The gross cost of advertising via television can be about $30 per thousand impressions, calculated using a combined rate of early morning, daytime, early news, late news, and prime time. The gross cost of advertising using a newspaper is about $52 per thousand impressions, calculated using a blended Sunday and daily rate. The gross cost of advertising using direct mail is about $182 per thousand impressions. As a result, a need exists for a method of advertising products to consumers that is cheaper than any of these conventional advertising methods but equally, if not more, effective.

While advertisers have used these conventional methods to advertise their goods, services and other items for years, each method has realized mixed results at best. One cause of the often poor results is that each of these methods passively engage consumers. For instance, advertisers using conventional advertising methods such as radio, television, magazines, newspapers, flyers, and the like simply place advertisements on medium having some likelihood of being seen or heard by the targeted consumers. While all advertisers desire that each one of their advertisements be placed in front of consumers, conventional advertising mechanisms have not resulted in such an outcome. For instance, not all advertisements placed in a newspaper are seen by consumers because most consumers do not look at every page of a newspaper. Instead, consumers often only glance at the front page of a couple of sections of the newspaper. As a result, advertisements included on inside pages of such newspapers did not result in an impression. Similar problems exist when advertising using radio stations. For example, consumers listening to radio station broadcasts have the option of not listening to advertisements by changing the radio station when advertisements are being broadcast. Thus, conventional methods of passive advertising do not result in an impression being made from each advertisement and often result in very poor percentages of impressions made per advertisement. Thus, a need exists for a method of advertising that increases the number of impressions made per advertisement.

Advertising has not been the only method by which manufacturers and others have attempted to influence the purchasing habits of consumers. Specifically, manufacturers have also attempted to increase sales by offering sales incentives, such as coupons. Coupons can include offers for mail-in rebates, redemptions, and savings at the point of sale. Coupons have historically been distributed to consumers through direct mailings, newspapers, magazines, affixed on grocery bags, printed on the back side of cash register receipts, and dispensed from dispensers located on shelving within an aisle of a store. Coupons have rarely been presented to consumers in a ready to use format. Rather, coupons are usually given to consumers in a form that requires consumers to remove them from larger items, such as newspapers or fliers. In addition, coupons distributed in this manner typically are made of thin paper that is unable to hold its shape and susceptible to being torn, wrinkled or crushed when placed in a woman's handbag or a gentleman's pocket. Such phenomena often causes consumers to disfavor using coupons. As a result, coupons presented to consumers in this fashion suffer from low redemption rates.

It is widely known within the retail industry that consumers purchase products based, in part, on convenience. This is equally true of coupon redemption. It is also true that most coupons are presented in a superfluous manner or at an inopportune time to consumers without inherent value or usefulness. Hence, only about one percent of all coupons issued are redeemed. If using a coupon is unduly burdensome, the consumer will be less likely to redeem the coupon. If the principal reason the consumer was going to purchase the product was because of the incentive offered on the coupon, the store and manufacturer are in danger of losing the sale. Therefore, a need exists for a device for supplying a purchasing incentive that is convenient to redeem and requires less effort than methods currently used.

SUMMARY OF THE INVENTION

This invention is a system and method for advertising and providing sales incentives for goods and services in a manner that stimulates sales while generating a profit for the entity employing this method. The invention includes placing marketing materials such as advertisements or sales incentives, or both, on a useful device such as a carrying strap containment device that is useful to a shopper at a store. Specifically, the device is capable of containing straps attached to shopping bags, such as those straps commonly found on a plastic shopping bag used at grocery stores.

The device is advantageous and welcomed by customers for numerous reasons. For instance, the device is welcomed by customers because it is provided to them free of charge. In addition, the device distributes the load from the carrying straps across a larger portion of a customer's hand than carrying straps used without the device, making it significantly more comfortable to carry the filled shopping bag. Additionally, the carrying strap containment device is welcomed by customers because it is a useful device that does not need to be cut out or otherwise modified before the customer can redeem it. The device also keeps the handles of bags separated for easy gripping when multiple bags are collected together, such as in the trunk of a customer's car. Further, the device prevents handles of a bag from separating, thus, keeping the goods within the bag. Finally, the carrying strap containment device is welcomed by stores and other entities because it is capable of traveling through the existing coupon redemption systems in place today within the United States.

The device preferably includes at least one surface capable of receiving an advertisement or sales incentive, or both. The advertisement or sales incentive can be located either on an inside or an outside surface of the device, or both. Advertisements can be directed to various items, including products, services, organizations, philanthropies, special events, sporting events, fund raising drives, sweepstakes, internet addresses for web sites and the like. Sales incentives can include coupons, rebates, "buy one, get one free" offers, and other purchasing incentives. In one embodiment, the carrying strap containment device can include an advertisement on the outside surface of each wall and on a base of the device and can include at least one coupon and redemption rules on the inside surface of the walls. Additionally, the walls can include a bar code that can be scanned at a cash register to redeem the coupon.

This method of generating revenue by placing advertisements or sales incentives on carrying strap containment devices can begin by giving solicitations to manufacturers of goods or service providers for advertisements or sales incentives, or both. Advertisements and sales incentives are then placed on the carrying strap containment devices in a manner agreed to by the advertiser and the entity, such as by printing or by using adhesives. In return, the manufacturer or service provider pays a fee for placing the advertisement or sales incentive on a specified number of carrying strap containment devices. The carrying strap containment devices are then packaged in easy to use dispensers. They can be shipped directly to the stores, or they first can be shipped to a distribution facility where the devices are stored and later shipped to individual stores when needed. The stores do not pay a fee for receiving or dispensing the devices.

The carrying strap containment devices are distributed to customers at the stores free of charge. Specifically, devices are distributed to customers by attaching them to shopping bags in the process of handing the bags to the customers during the checkout process. Each store counts and records the number of devices that are distributed. In turn, each store is paid for distributing the devices an amount based upon the number of devices distributed.

If the carrying strap containment device contains a sales incentive, a customer can redeem it in a variety of manners. For instance, if the sales incentive is a coupon, the customer can return the coupon to a participating store for redemption. The customer does not need to remove the coupon from the device, as is typically required of other coupons, nor is the customer required to alter the shape of the coupon prior to redemption. Instead, the coupon can be redeemed while it is on the carrying strap containment device. Further, if the carrying strap containment device includes a rebate, the customer can redeem it by following the instructions on the carrying strap containment device, which typically requests that the customer mail the rebate to a clearinghouse to receive the rebate. As with a coupon, the rebate does not need to be removed from the carrying strap containment device before it can be redeemed. Instead, the entire carrying strap containment device can be mailed to an address designated on the device.

After a store has redeemed a coupon, the coupon is processed using the existing coupon processing systems currently in place within the United States. Further, these systems do not need to be modified to process coupons located on the carrying strap containment devices. Instead, these systems can process the coupons located on the carrying strap containment devices and do not require that the coupons be removed from the devices for processing. These systems include clearinghouses that handle the transfer of money between stores and manufacturers and others who offer sales incentives.

The effectiveness of this method can be measured by comparing the number of sales incentives redeemed with the number of devices distributed. This comparison can be completed by each store or by the entity distributing the devices to each store.

An advantage of this invention is that it provides in-store advertising and sales incentives on a device that is useful and welcomed by customers. Further, this invention actively engages customers by presenting them with useful devices that include either. advertisements or sales incentives, or both because each advertisement or coupon is placed in the hand of a consumer in such a manner that the consumer can view the advertisement. Thus, this invention results in increased impressions made per advertisement when compared with impressions made using conventional mediums.

Another advantage of this invention is that it solves' the problem of not being able to generate a positive revenue stream from placing advertisements and sales incentives on a carrying strap containment device. The invention enables an entity to generate revenue by placing advertisements and sales incentives on useful devices.

Yet another advantage of this invention is that it actively engages a customer with in-store advertising after a customer has purchased goods. The device is almost certain to be taken into the home of the customer because the device is attached to the carrying straps of the shopping bag. Indeed, the device is typically literally placed in a customer's hand. Should a device not make it into a customer's home because a customer removes the device from a bag before entering the home, the advertisement would have accomplished its goal of making an impression on a customer because the customer would have viewed the advertisement, at least peripherally, while removing the device.

Still another advantage of this invention is the combination of an advertisement vehicle and a sales promotion vehicle with a useful device to significantly increase the likelihood of selling a product. In effect, the useful device serves as a mechanism to covert impressions made by the device into sales in a direct, convenient, and economically efficient manner, which is exactly the outcome that conventional advertising mechanisms have been unable to accomplish.

Another advantage of this invention is that a sales incentive is given to a customer in a form that is immediately redeemable without requiring the customer to first locate and then remove the incentive from another publication, such as a newspaper or flier. Further, the sales incentives can be processed through the existing coupon clearinghouse systems that are used today in the United States without modification.

Yet another advantage of this invention is that the device presents sales incentives to a customer in a convenient form and material, and at a time convenient for the customer to view the sales incentive and to store it in a convenient place, such as his or her car, so that he or she may easily remember to redeem it upon his or her return to the store. Also, sales incentives are provided to the customers using useful devices made of sturdy materials that enable the devices to hold their shape and not tear, wrinkle or be crushed when placed in a woman's handbag, a gentleman's pocket or during the redemption process.

Still another advantage of this invention is that the method provides an incentive for each store to distribute the carrying strap containment devices to its customers and does not simply rely on a store's motivation to distribute the devices. Specifically, each store is paid to distribute the devices based on the number of devices distributed by the store to its customers.

Another advantage of this invention is that stores employing this method realize a significant cost savings associated with supplying bags because this invention encourages customers to use plastic bags rather than more expensive paper bags.

Yet another advantage of this invention is that the method uses carrying strap containment devices that require little, if any, training for store personnel to be able to install the devices on shopping bags. Instead, the process by which these devices are installed is evident to most store personnel without need for explanation. This is extremely advantageous because most stores are unwilling to train their store personnel that bag merchandise who have an annual turnover rate of almost 100 percent.

Still another advantage of this invention is that installing these devices on carrying straps coupled with bags does not require that additional store personnel be hired because the process of installing the devices requires little time and little, if any, training.

Another advantage of this invention is that the device supports the straps of a typical plastic bag so that when installed, the handles of the bag stand upright without other assistance and prevent the contents of the bag from spilling out of the bag. The device acts as a structural cross beam that pulls two straps together and bridges the gap between each side of the bag. As a result, the strap remains upright, and the device remains in a position that is visible to the customer each time the customer grabs for the straps of the bag. Thus, the device, and thereby the advertisements and sales incentives, are highly visible by the customer when installed on a grocery bag.

Another advantage of this invention is that the device enables a retailer to place more items within a plastic bag than possible without use of the device. Thus, a retailer uses fewer plastic bags when employing this method. As a result, the retailer is inclined to distribute the devices to its customers in order to realize the cost savings associated with using fewer plastic bags.

Yet another advantage of this invention is the realization of significant cost savings to advertisers because the carrying strap containment devices are at least ten times cheaper than other methods of advertising and sales promotions currently used.

Still another advantage of this invention is that advertisements and sales incentives included on carrying strap containment devices may be changed without incurring additional charges to the advertisers two or three times during a typical four week advertising cycle, thereby constantly refreshing the advertisements and sales incentives on the devices and enhancing the value of the devices to the customer. In contrast, other forms of in-store and out-of-store advertising are incapable of changing as quickly because such changes would be prohibitively expensive.

Another advantage of the invention is the ability to enhance customer goodwill, brand loyalty, and product differentiation.

Yet another advantage of this invention is that this method provides advertisers of good and services with an economical method of placing their advertisements in front of a massive number of consumers that previously were unavailable to the advertisers, except by using very expensive advertising methods that are much less effective.

Still further objects and advantages will become apparent from consideration of the following description and drawings.

DETAILED DESCRIPTION OF THE DRAWINGS

Figure 1:
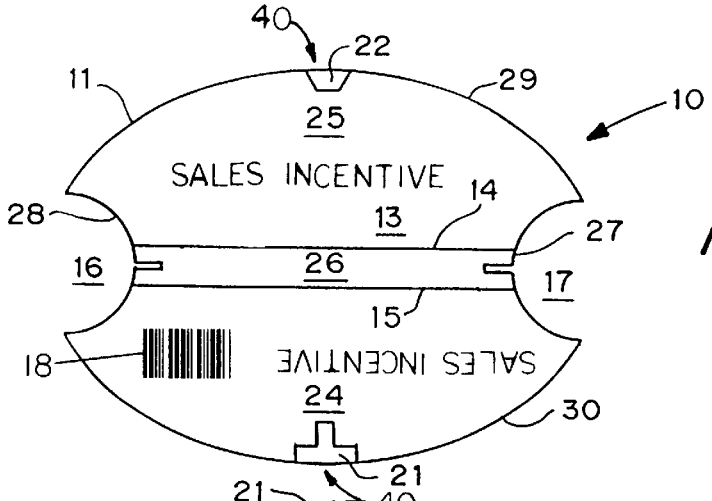
FIG. 1 shows an inside surface of an exemplary carrying strap containment device.

This invention is a system and method for advertising and providing sales incentives to customers of items, such as goods and services, in a manner that stimulates sales while generating revenue for the entity employing this method. In this invention, marketing materials such as advertisements and sales incentives are provided to customers on carrying strap containment devices 10 or other useful devices. Other useful devices can include paper grocery bags, hand-held, manual fans, and other devices having a surface capable of receiving a sales incentive or an advertisement. An exemplary embodiment of a carrying strap containment device 10 is-shown in FIGS. 1–3. However, the carrying strap containment device 10 is not limited to this embodiment. Rather, the carrying strap containment device 10 can be formed in many different shapes and formed from many different materials. The entity employing this method can be an individual, a parent company of a store, an independent company, the store itself that distributes carrying strap containment devices or other useful devices to customers, a division of the store, or another entity.

In this exemplary embodiment of a carrying strap containment device 10, device 10 is formed from a die-cut blank 11. Blank 11 is die cut from a flat semi-rigid sheet of material, for example, cardboard, fiberboard, paperboard, styrene foam or other plastics. Blank 11 has a inside surface 13 and a outside surface 12, shown in FIG. 2. Inside surface 13 contains two parallel fold-lines 14 and 15 running the length of blank 11. Blank 11 also has two semicircular apertures 16 and 17 located at each end 27 and 28 of blank 11. Because of the thickness of blank 11, the device 10 resists tearing during use. Further, the thickness allows walls 24 and 25 to be folded along fold-lines 14 and 15 on base 26. Outside surface 12 and inside surface 13 of blank 11 preferably have smooth textures, but may contain waffling to provide additional strength to the device 10.

It is preferable that the device 10 include at least one surface capable of receiving either an advertisement or a sales incentive. Unobstructed surface space on walls 24 and 25 is important so that the device 10 can receive an advertisement or a sales incentive, or both. In the exemplary embodiment, outside surface 12 and inside surface 13 should be of a sufficient size to receive an advertisement or a sales incentive and large enough to be easily read and processed. One of the surfaces may need to be imprinted with a bar code 18.

Figure 2:
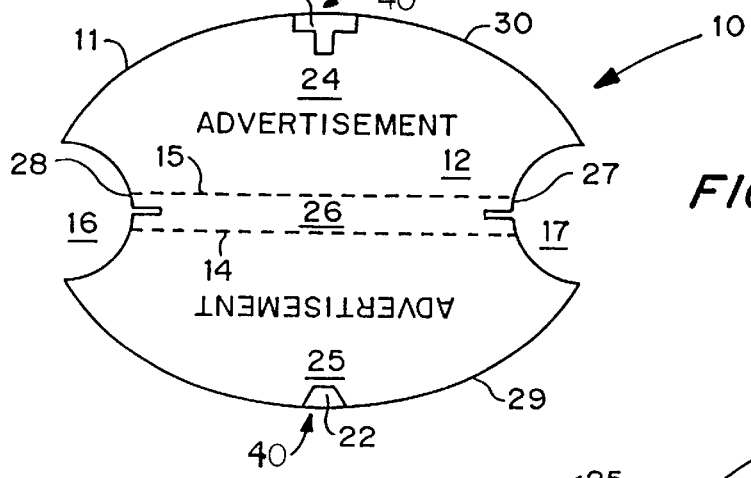
FIG. 2 shows an outside surface of an exemplary carrying strap containment device.
Figure 3:
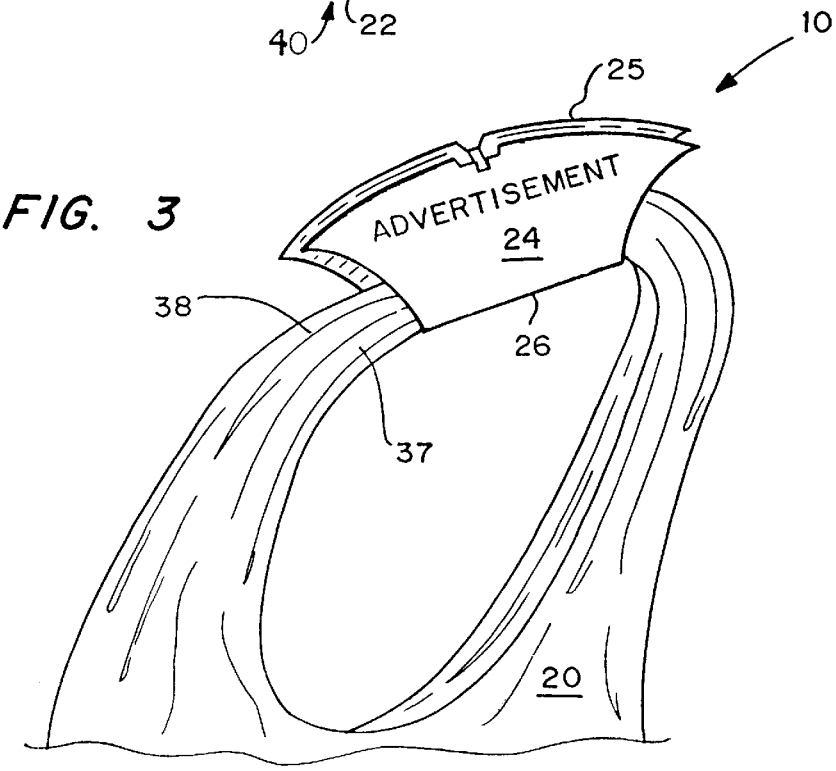
FIG. 3 is a perspective view showing the carrying strap containment device of FIGS. 1 and 2 attached to carrying straps of a shopping bag.

Still referring to FIGS. 1 and 2, a locking mechanism 40 may be integrally formed in blank 11 during the die cutting process. The locking mechanism 40 is composed of a small tab 21 that is integrally cut into edge 30 of blank 11 in the shape of a "T," as shown in FIGS. 1 and 2. Alternatively, tab 21 can be formed from another shape. Tab 21 and groove 22, for receiving tab 21, are formed in the outer edges of blank 11. In coupling a device 10 to bag 20, as shown in FIG. 3, or group of bags 20, device 10 is positioned proximate to straps 37 and 38 of a bag 20, and tab 21 on wall 24 is bent over wall 25, locking tab 21 into groove 22 in wall 25. Tab 21 and groove 22 are located on the outer edges of blank 11 so that walls 24 and 25 have an unobstructed surface space. However, locking mechanism 40 can be located within interior portions of walls 24 and 25. In other devices 10, locking mechanism 40 can include adhesives placed on inside surface 13 and mechanical coupling devices other than the T-shaped tab 21.

Figure 4:
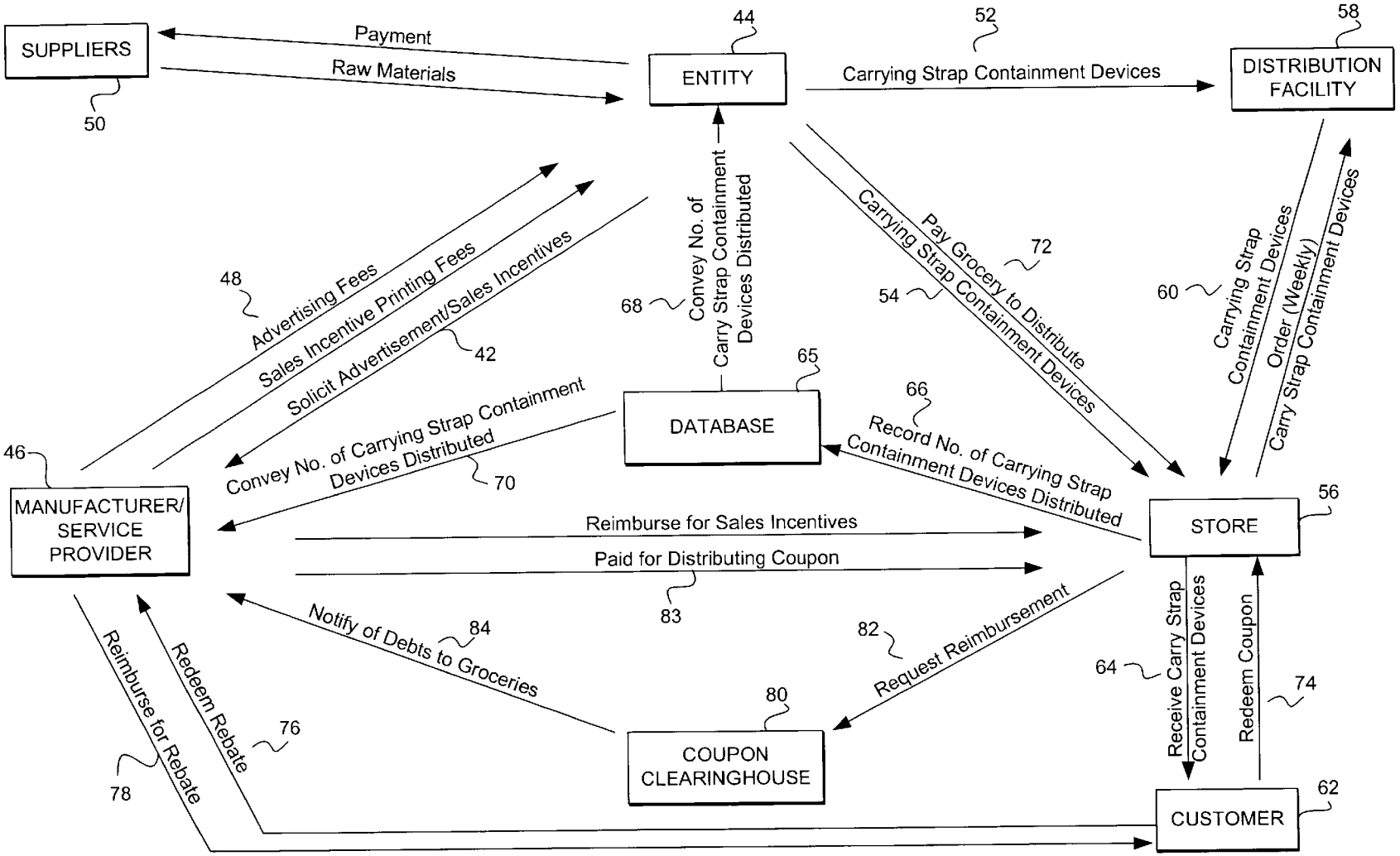
FIG. 4 is a flow chart showing the method of generating revenues from placing advertisements or sales incentives, or both, on carrying strap containment devices and distributing those devices to customers and processing their redemption.

The method of this invention, as shown in detail in FIG. 4, includes solicitation 42 of a provider of an item, such as a manufacturer of goods or a supplier of services, or both, for an advertisement or a sales incentive, or both, to be placed on a carrying strap containment device 10. Additionally, other entities can be the subject of solicitation 42, such as promoters of special events and sporting events, stores, and others. Advertised goods can include items typically found within a grocery store, such as cereal, produce, canned goods, snacks, chips, soft drinks, milk, stationary, or others. However, advertised goods are not limited to just those products found within a grocery store. For instance, advertised goods can include eyeglasses, automobile supplies, sporting goods, apparel, and anything else that an entity desires to advertise. Advertised services can include those services performed by barber shops, hair stylists, repairmen, such as plumbers or electricians, yard maintenance workers, automobile repair shops and others. Advertisements can also include sweepstakes or internet addresses for web sites. A sales incentive typically is in the form of a coupon including a price reduction that can be redeemed at the point of sale, such as at a cash register during the checkout process. However, the sales incentive can also be a rebate that can be redeemed by a customer at a later time by, for example, mailing it to a central processing facility that responds by sending a check to the customer in the amount of the rebate. The sales incentive can also include offers such as "buy one, get one free," incentives based on the number of visits made to a particular store, and others.

In return for placing an advertisement or a sales incentive on a carrying strap containment device, the entity 44 soliciting the manufacturer or service provider 46 receives payment 48 for placing the advertisement or sales incentive on the carrying strap containment device. In one embodiment, the manufacturer or service provider 46 is charged about $13 per 1,000 impressions for having an advertisement or a sales incentive placed on an entire side, such as on 12 or 13, and is charged about $7 per 1,000 impressions for having an advertisement or a sales incentive placed on only one side, 12 or 13, of a single wall, 24 or 25. Payment can be in the form of cash, an offset against an existing account, or other forms agreed to between the parties. The entity 44 soliciting the manufacturer or service provider 46 can place the advertisement or sales incentive on the carrying strap containment device 10 itself or it can engage another entity to complete this work. If the entity 44 completes this work, the entity 44 receives raw materials from various suppliers 50.

The advertisement or sales incentive can be printed on the outside surface 12 or inside surface 13, or both, of the carrying strap containment device 10. For instance, as shown in FIG. 2, an advertisement can be placed on the outside surface 12 of each wall 24 and 25 of a device 10. In one embodiment, each wall 24 and 25 may contain both an advertisement and a sales incentive. Further, an advertisement or a sales incentive, or both, can be placed on the outside surface 12 or the inside surface 13 of the base 26 of the carrying strap containment device 10. Advertisements on a single device 10 can be directed to the same product or service, different products or services produced by the same manufacturer or offered by the same service provider, or different products or services offered by different manufacturers or service providers. The advertisements and sales incentives can be printed in full color graphics or in black and white print. Alternatively, the advertisement or sales incentive can be adhered to a surface of the carrying strap containment device 10, rather than being printed on the surface.

In one embodiment, as shown in FIGS. 1 and 2, carrying strap containment device 10 can include an advertisement on the outside surface 12 of walls 24 and 25. Each wall can include the same or different advertisements. Additionally, an advertisement can be located on the outside surface 12 of base 26. The inside surface 13 of the device 10 can include a coupon and redemption rules that detail how a customer can redeem the sales incentive. Further, the inside surface 13 can include a bar code 18. The bar code 18 can be used during the redemption process so that a cashier can scan the coupon, or multiple coupons, during the checkout process. Additionally, the bar code 18 can be used to track the number of devices that have been distributed by a store to its customers.

After the advertisement or sales incentive, or both, have been placed on the carrying strap containment devices 10, the devices 10 are packaged within a dispenser for distribution. The dispenser should be designed to allow for easy removal of the devices while the dispenser is positioned within the checkout line. Preferably, the dispenser should be sized to fit within the grocery collection area in the checkout line so that bagboys can easily grab the devices and place the devices on the bags. In addition, the dispenser should not interfere with the conventional bagging process used by grocery stores today. Specifically, using the dispenser should not slow down the checkout process at a cash register. Typically, the dispenser can be a carton made of cardboard that has openings allowing for easy removal of the carrying strap containment devices 10 by store employees. The dispenser is preferably made of cardboard so that the dispenser can be disposed of after it has been used. Alternatively, the devices 10 can be shipped to the stores 56 pre-attached to the bags 20 rather than being placed within a dispenser alone.

Once the devices 10 have been packaged, the devices 10 are distributed to stores 56. The stores 56 can include grocery stores, wholesale warehouses, membership warehouses, department stores, and other stores that use bags 20 with straps to contain merchandise purchased by customers 62 so that the customers 62 can easily carry the goods out of the store 56 at 52. The carrying strap containment devices 10 can be distributed to stores 56 by first distributing the devices 10 to a distribution facility 58 used by a chain of stores 56. From the distribution facility 58, the devices 10 can be distributed to the individual stores 56 as necessary using the existing shipping system at 60. Alternatively, the devices 10 can be distributed directly to the stores 56 without first being distributed to the distribution facility 58 at 54.

After a store 56 has received the packaged carrying strap containment devices 10, the devices 10 are attached to carrying straps of shopping bags 20 and are distributed to customers 62 free of charge during the checkout process. For instance, when the devices 10 are used in grocery stores, the packaged devices 10 can be stored in the checkout line within the grocery collection area. As the bagboys fill shopping bags 20 having straps with groceries, the bagboys secure a carrying strap containment device 10 around the straps of each bag 20. The carrying strap containment devices 10 are distributed to each customer 62 without charge at 64. The carrying strap containment device 10 conveniently holds the straps of a bag 20 together even when a customer 62 is not holding the device 10. Further, the carrying strap containment device 10 evenly distributes the load generated by the contents of a bag 20 across the device 10. Thus, the device 10 effectively reduces the pain typically generated by lifting a heavy bag 20 using its carrying straps.

The number of carrying strap containing devices 10 that are distributed to customers 62 is counted and recorded in a database 65 at 66. The number of devices 10 distributed can be tracked by each store 56. In addition, the entity 44 can track the number of devices 10 distributed to each store 56. This amount can be used to identify inaccuracies made in counting the number of devices 10 distributed or it can be used as the primary method for counting the number of devices 10 distributed. This amount is communicated 68 to the entity 44. Alternatively, the amount can be communicated 70 to the manufacturer or service provider 46.

The entity 44 sends payment 72 to each store 56 that distributes the devices 10 at 72. The entity 44 may pay each store 56 directly or may pay each store 56 through any number of intermediaries, such as through intermediate entities as agreed by each store 56 and the entity 44. The stores 56 are paid based on the number of devices 10 distributed to customers 62. Further, the stores 56 do not pay the entity 44 for receiving the carrying devices 10. Instead, the devices 10 are provided to the stores 56 free of charge. Therefore, each store 56 realizes nearly 100 percent profit for distributing each carrying strap containment device 10 because neither additional labor nor additional floor or shelf space are required. Such a highly profitable item is highly sought after in any industry and especially in the grocery industry, where profit margins are small.

Each store 56 receives payment 72 on a periodic basis, such as a monthly basis, for distributing the devices 10. However, each store 56 can be paid on a weekly, biweekly, bimonthly, quarterly, semiannually, yearly or according to another time period. Each store 56 and entity 44 can establish a preferred method of being paid. For instance, the entity 44 can request that it receive an invoice indicating the number of devices 10 distributed for a given period. Further, the invoice could show the number of devices 10 distributed per day. The invoice could be sent electronically, by mail, by courier or by another method to the entity producing the carrying strap containment devices 10. A store 56 may request that it be paid by having the entity 44 deposit its payment into a specific bank account or by having the entity 44 mail a check to the store 56. Alternatively, the store 56 could request that it receive free advertising in exchange for the amount due.

By including advertising or sales incentives, or both, on the carrying strap containment device 10, a manufacturer or service provider 46 is assured that a customer 62 will see each advertisement or sales incentive placed on a device 10 that is distributed because each customer 62 will see the advertisement or sales incentive as he or she reaches for and grasps a device 10. Specifically, the customer will see the device including the advertisements as it sits attached to the bag in the grocery cart, again as the device and bag are lifted into the car trunk and again when the device and bag are lifted out of the trunk of the customer's automobile. Further, because the carrying strap containment device 10 is attached to a bag 20 filled with groceries, nearly every device 10 will be brought into each customer's home. Once in the home, the customer 62 once again views the advertisement on the device 10 as the customer 62 removes the device 10 from the bag 20 in order to remove the contents of the bag 20. It is highly inconvenient, and nearly impossible, to remove the contents of a plastic bag without first removing the carrying strap containment device 10, thus causing the customer to view the advertisement on the device. These repeated impressions made by the branding and logo of the advertiser on the device 10 are highly sought after by advertisers.

As described above, the carrying strap containment device 10 can further include a sales incentive. If the sales incentive is a coupon offering a discount for a subsequent purchase, for example, 50 percent off, or an offer such as "buy one, get one free," the customer 62 may redeem the coupon at a store 56 at 74. A significant advantage of this invention is that the customer 62 does not need to make any adjustments to the coupon. Instead, the customer 62 can redeem the coupon as it is found on the carrying strap containment device 10. In other words, the customer 62 does not need to remove the coupon from the carrying strap containment device 10, as would be required if it were located in a newspaper or a flier. Instead, the customer 62 can take the carrying strap containment device 10 to a store 56 in the same condition as it was received, presumably with signs of being used, to redeem the sales incentive offered on the coupon. If the sales incentive is a rebate, a customer 62 can redeem the rebate at 76 by following the instructions printed on the rebate, which may state that the rebate should be mailed to the address listed on the rebate notice on the device 10 without having to physically alter the shape of the device 10. In response, the manufacturer or service provider 46 provides reimbursement 78 to the customer 62.

If a store 56 is presented with a carrying strap containment device 10 having a coupon capable of being redeemed at a store 56, the store 56 should honor the coupon by redeeming it at 74. In one embodiment, the store 56 can request reimbursement 82 from a sales incentive clearinghouse 80 after it has redeemed a coupon for a customer. In this embodiment, the clearinghouse 80 can pay 83 the store 56 for redemption of the coupon and can subsequently seek reimbursement 84 from the manufacturer or service provider 46. A significant advantage of using a carrying strap containment device 10 is that a coupon located on its surface can be processed through the existing clearinghouse systems that are? currently in use without any modifications. Thus, neither the customer or the store is inconvenienced by redeeming a coupon on a carrying strap containment device.

The clearinghouse 80 can be the Automated Clearing House (ACH), which is a government regulated system and network for transferring money. The ACH network is capable of processing payment of a manufacturers' product discounts and is capable of processing fees associated with the network of participating stores. Using the ACH network greatly reduces time requirements, increases accuracy, reduces costs and deceases fraud associated with coupon redemption. Each product discount distribution, the processing fee for handling the product discount distribution, and the handling fee paid to stores are debited from a manufacturer's debit account and paid to a stores' and financial institutions' ACH credit account.

Alternatively, the clearinghouse 80 can collect the amount of redemptions made by a store and notify the manufacturer or service provider of all redemptions made by a particular store for a designated time period, such as weekly, biweekly, monthly, or according to another time period at 84. The manufacturer or service provider 46 can then pay the store 56 or an intermediary, such as a holding company, the amount redeemed by the customer 62.

At the conclusion of the process, the effectiveness of this system is determined by comparing the number of sales incentives that have been redeemed for a given time period with the number of sales incentives distributed for that same time period. This comparison can be made by each store 56 distributing the devices 10 to the customers, by the entity 44 distributing the devices 10 to the stores 56, or by another entity. The results can be used to make various business decisions.

The foregoing is provided for purposes of illustrating, explaining, and describing embodiments of this invention. Modifications and adaptations to these embodiments will be apparent to those skilled in the art and may be made without departing from the scope or spirit of this invention or the following claims.

We claim:

1. A method for advertising on a carrying strap containment device, comprising;

soliciting payment for at least one advertisement from a provider of goods or services;

receiving payment from the provider of goods or services for the at least one advertisement;

placing the at least one advertisement on the carrying strap containment device;

delivering at least one carrying strap containment device to at least one store without charge for the at least one carrying strap containment device;

distributing the at least one carrying strap containment device to at least one customer without charging the at least one customer a fee for the at least one carrying strap containment device; and paying the at least one store for distributing the at least one carrying strap containment device to the at least one customer.

2. The method of claim 1, wherein placing the at least one advertisement on the carrying strap containment device comprises printing the advertisement on the carrying strap containment device.

3. The method of claim 1, wherein placing the at least one advertisement on the carrying strap containment device comprises adhering the at least one advertisement to the carrying strap containment device.

4. The method of claim 1, wherein the at least one carrying strap containment device is distributed to at least one store through a store distribution system.

5. The method of claim 1, wherein the at least one store distributes multiple carrying strap containment devices to at least one customer.

6. The method of claim 5, wherein paying the at least one store further comprises calculating payment based upon the number of carrying strap containment devices distributed to the at least one customer, counting and recording the number of carrying strap containment devices distributed.

7. The method of claim 6, wherein counting and recording the number of carrying strap containment devices distributed is completed by the at least one store.

8. The method of claim 6, wherein counting and recording the number of carrying strap containment devices distributed is completed by an entity who distributes the carrying strap containment devices to the at least one store.

9. The method of claim 1, wherein the carrying strap containment device comprises:

a blank of pliable material having a top surface, a bottom surface and a periphery comprising a first convex edge, a second convex edge, a first concave edge and a second concave edge, wherein the first and second convex edges are separated by the first and second concave edges and wherein the first and second convex edges are symmetrical and the first and second concave edges are symmetrical;

two integrally formed, parallel fold-lines joining the first and second concave edges, wherein a first wall, a second wall and a base are formed when the blank is folded along the two integrally formed, parallel fold-lines, wherein the first wall and the second wall are symmetrical;

a tab formed on the first convex edge on the first wall; and a groove formed on the second convex edge on the second wall for receiving the tab.

10. A method of distributing incentives to customers on a carrying strap containment device, comprising;

soliciting payment from a provider of goods or services for placing at least one incentive on the carrying strap containment device;

receiving payment from the provider of goods or services for placing the at least one incentive on the carrying strap containment device;

placing the at least one incentive on the carrying strap containment device;

delivering at least one carrying strap containment device to at least one store without charge for the at least one carrying strap containment device;

distributing the at least one carrying strap containment device to at least one customer without charging the at least one customer a fee for the at least one carrying strap containment device; and paying the at least one store for distributing the at least one carrying strap containment device to the at least one customer.

11. The method of claim 10, wherein placing the at least one incentive on the carrying strap containment device comprises printing the incentive on the carrying strap containment device.

12. The method of claim 10, wherein placing the at least one incentive on the carrying strap containment device comprises adhering the at least one incentive to the carrying strap containment device.

13. The method of claim 10, wherein the at least one carrying strap containment device is distributed to at least one store through a store distribution system.

14. The method of claim 10, wherein the at least one incentive comprises a coupon.

15. The method of claim 10, wherein the at least one incentive comprises a rebate.

16. The method of claim 10, wherein the at least one store distributes multiple carrying strap containment devices to at least one customer.

17. The method of claim 16, wherein paying the at least one store further comprises calculating payment based upon the number of carrying strap containment devices distributed to the at least one customer, counting and recording the number of carrying strap containment devices distributed.

18. The method of claim 17, wherein counting and recording the number of carrying strap containment devices distributed is completed by the at least one store.

19. The method of claim 17, wherein counting and recording the number of carrying strap containment devices distributed is completed by an entity who distributes the carrying strap containment devices to the at least one store.

20. The method of claim 10, further comprising determining the number of incentives redeemed.

21. The method of claim 20, further comprising conveying the number of incentives redeemed by customers to the provider of goods or services.

22. The method of claim 10, wherein the carrying strap containment device comprises:

a blank of pliable material having a top surface, a bottom surface and a periphery comprising a first convex edge, a second convex edge, a first concave edge and a second concave edge, wherein the first and second convex edges are separated by the first and second concave edges and wherein the first and second convex edges are symmetrical and the first and second concave edges are symmetrical;

two integrally formed, parallel fold-lines joining the first and second concave edges, wherein a first wall, a second wall and a base are formed when the blank is folded along the two integrally formed, parallel fold-lines, wherein the first wall and the second wall are symmetrical;

a tab formed on the first convex edge on the first wall; and a groove formed on the second convex edge on the second wall for receiving the tab.

23. A method of increasing sales of an item through a useful article, comprising;

soliciting payment from a provider of an item for placing at least one incentive on a carrying strap containment device;

receiving payment from the provider of an item for placing the at least one incentive on the carrying strap containment device;

placing the at least one incentive on the carrying strap containment device;

delivering at least one carrying strap containment device to at least one store without charge for the at least one carrying strap containment device;

distributing the at least one carrying strap containment device to at least one customer without charging the at least one customer a fee for the at least one carrying strap containment device;

paying the at least one store for distributing the at least one carrying strap containment device to the at least one customer;

determining the number of incentives redeemed by the at least one customer; and determining the effectiveness of the method.

24. The method of claim 23, further comprising:

soliciting payment from a provider of an item for placing at least one advertisement on a carrying strap containment device;

receiving payment from the provider of an item for placing the at least one advertisement on the carrying strap containment device; and placing the at least one advertisement on the carrying strap containment device.

25. The method of claim 23, wherein the item is selected from the group consisting of goods and services.

26. A method of distributing marketing materials to customers on a useful article, comprising:

soliciting payment from a provider of goods or services for placing at least one marketing material on the useful article;

receiving payment from the provider of goods and services for placing the at least one marketing material on the useful article;

placing the at least one marketing material on the useful article;

delivering at least one useful article to at least one store without charge for the at least one useful article;

distributing the at least one useful article to at least one customer without charging the at least one customer a fee for the at least one useful article; and paying the at least one store for distributing the at least one useful article to the at least one customer.

27. The method of claim 26, wherein the useful article is a carrying strap containment device.

28. The method of claim 26, wherein the at least one marketing material comprises a sales incentive.

29. The method of claim 28, wherein the sales incentive comprises a rebate.

30. The method of claim 28, wherein the sales incentive comprises a coupon.

31. The method of claim 26, wherein the at least one marketing material comprises an advertisement.

* * * * *